US005318327A

United States Patent [19]

Daneshvar

[11] Patent Number: 5,318,327

[45] Date of Patent: Jun. 7, 1994

[54] ROMANTIC CARD

[76] Inventor: Yousef Daneshvar, 21459 Wood Farm, Northville, Mich. 48167

[21] Appl. No.: 736,520

[22] Filed: Jul. 26, 1991

[51] Int. Cl.[5] ..... B42D 15/00

[52] U.S. Cl. ..... 283/117; 40/124.1

[58] Field of Search ..... 283/117; 40/124.1

[56] References Cited

U.S. PATENT DOCUMENTS

| | | | |
|---|---|---|---|
| 2,217,454 | 10/1940 | Pfeiffer | 40/124.1 |
| 2,621,784 | 12/1952 | Van Boytham | 206/46 |
| 4,404,764 | 9/1983 | Wills et al. | 283/117 X |
| 4,422,672 | 12/1983 | Levi | 412/901 X |
| 4,484,768 | 4/1986 | Norfleet | 40/124.1 X |
| 4,584,213 | 4/1986 | Rentowl | 40/124.1 X |
| 4,715,759 | 12/1987 | Larque | 412/901 X |
| 4,787,160 | 11/1988 | Balsamo | 281/51 X |
| 4,826,211 | 5/1989 | Sinnott et al. | 283/117 |
| 4,930,928 | 7/1990 | Ristuccia, Sr. | 402/79 |
| 4,953,780 | 9/1990 | Ross | 229/92.8 |

FOREIGN PATENT DOCUMENTS

| | | | |
|---|---|---|---|
| 1355028 | 2/1964 | France | 40/124.1 |
| 2536342 | 5/1984 | France | 40/124.1 |
| 8219829 | 5/1984 | France . | |
| 7403206 | 9/1975 | Netherlands . | |
| 1677 | of 1906 | United Kingdom . | |

*Primary Examiner*—Paul A. Bell

[57] ABSTRACT

A romantic greeting card which has several distinct use zones for conveying romantic feelings from the sender to the recipient. One use zone is an adhesive zone that is covered by selectively removable sections of release paper for exposing a desired area of adhesive to be used for mounting a photograph of the sender. Another is a hair-clipping receiving zone also covered by release paper for adhering hair clippings to the card. Other zones are a scent-receiving zone and a greeting message receiving zone. A sticker in the shape of a bow may be used to mount hair clippings to the card.

12 Claims, 4 Drawing Sheets

ROMANTIC CARD

FIELD OF THE INVENTION

This invention relates generally to greeting cards. More specifically, the invention relates to a personalized romantic card for enabling a person to express his or her nice feelings in a romantic and special way.

BACKGROUND AND SUMMARY OF THE INVENTION

One of the very valuable things in the world is to relay our nice and romantic feelings to ones we love. The present invention serves that purpose, and it is believed that a greeting card embodying the inventive principles will in many cases create nice feelings in the recipient, especially feelings of romance and true love, in a more effective way than customary greeting cards.

A preferred embodiment of card according to the invention comprises four pages: 1) a front, or cover, outside page; 2) a left-hand inside page that is obverse to the front, or cover, page; 3) a right-hand inside page that is opposite the left-hand inside page; and 4) a back outside page that is obverse to the right-hand inside page. The cover page contains printed matter such as a title. The left-hand inside page contains picture-mounting means providing for the sender of the card to mount thereon his or her picture. The right-hand inside page contains hair-mounting means providing for the sender to mount thereon clippings of his or her hair, kiss-impression receiving means providing for the sender to place thereon a colored impression of his or her kiss by using a colorant previously applied to his or her lips, and a print-receiving means providing for the sender to convey a personalized verbal greeting. The back page may be either blank or may alternatively contain a short story, such as a great love story or the like. The romantic card of the present invention is intended to be used on various occasions, such as sending best wishes, get-well-soon wishes, Valentine wishes, or birthday wishes, or on any occasion where the sender wishes to express his or her romantic and nice feelings to others in a special personalized way.

There are several related aspects of the invention, and one of them involves the colorant that is used by the sender to create the colored impression of his or her lips. The colorant is provided in a special applicator package that is especially convenient for accompaniment of the card at the time the sender purchases the card. Alternatively, the packaged colorant may be sold separately, and the special applicator package may be used separately from the romantic card, such as by ladies for applying lipstick. Moreover, it may be used for applying other than colorant or lipstick to the lips, such as applying medication to the lips; it may also be used for applying any of various medications to any of various parts of the body.

Further features, advantages, and benefits of the invention will be seen in the ensuing description and claims which are accompanied by drawings. The drawings disclose a presently preferred embodiment of the invention according to the best mode contemplated at this time for carrying out the invention.

DESCRIPTION OF THE PREFERRED EMBODIMENT

Figure 1:
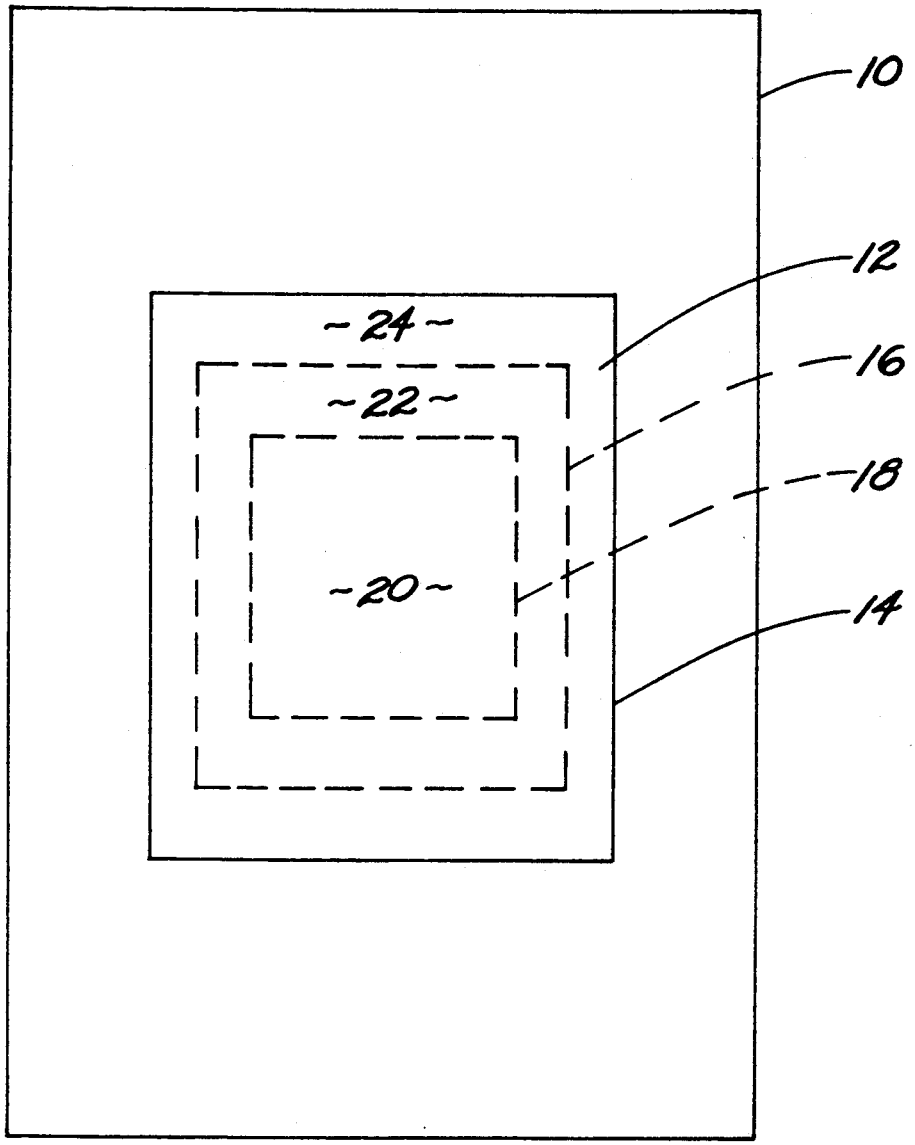
FIG. 1 is a plan view of the left-hand inside page of a romantic card according to the invention.

The preferred embodiment of romantic card comprises the four pages mentioned above and may be constructed by conventional card making procedures. For example, the four pages can be fabricated by starting with a sheet of card paper that is eight and one-half inches wide by eleven inches long, and folding it widthwise into two equal halves so as to create a four page card in which each page is eight and one-half inches tall by five and one-half inches wide.

Although the front, or cover, page is not specifically shown in the drawing, it will contain printed material, such a title, mentioned above, or some other introduction. A special introduction which I have created for the front page comprises a design in the shape of a colored heart, preferably red, in the upper right-hand corner and accompanied by remarks such as "Special Kiss", "Only for you", or "Just for you" below the heart and toward the center of the page. The front page may have a picture of a kiss, flower, or flowers, or other pictures or printed material. It may also have a colored rim around it.

The second page is the left-hand inside page and it contains picture mounting means in the center providing for the sender to mount thereon a photograph. This is explained with reference to FIG. 1. This page of the card is designated 10 in the drawing. It is manufactured so that the card paper contains thereon a zone of gluey, or sticky, material that is covered by a selectively removable covering, or release, paper 12 which has a glossy side toward the gluey zone. In FIG. 1, the zone that contains the gluey material is rectangular in shape and centered on the page. It is identified by the numeral 14 and is covered by covering paper 12. The two rectangular-shaped broken lines 16 and 18 that are shown concentric with covering paper 12 are two separate cuts or scores in covering paper 12. Their purpose is to allow selective removal of certain portions of the covering paper by the sender depending upon the particular size of photograph that is to be mounted on this page. Thus the entire covering paper may be removed for mounting a photograph of equal or greater area; the area bounded by line 16 may be removed for mounting a photograph of equal or greater area that is typically less than the area of the entire covering paper; and the area bounded by line 18 may be removed for mounting a photograph of equal or greater area that is typically less than the area bounded by line 16. In other words, the covering paper comprises a central rectangular core 20 that is bounded by line 18, a first rectangular frame 22 of uniform width that bounds core 20, and a second rectangular frame 24 that bounds frame 22. For decorative purposes, the exposed face of the covering paper may contain different designs and shapes, such as flowers or pictures of the famous stars, or other designs, shapes, or colors. An alternate form for the gluey zone 14 may comprise bands or lines of gluey areas covered by covering bands or papers. While the provision of a gluey zone, as described herein, is believed to be per se novel, the combination of a picture mounting means with other aspects herein described are believed also novel, and thus in such combinations a picture may be attached or glued by other methods. Likewise, sheet material other than a photograph of the sender may be applied to the gluey zone, for example a picture or a visiting card.

The third page is the right-hand inside page and it contains hair-mounting means providing for the sender to mount thereon clippings of his or her hair, kiss-impression receiving means providing for the sender to place thereon a colored impression of his or her kiss by using a colorant previously applied to his or her lips, and a print-receiving means providing for the sender to convey a personalized verbal greeting. These features are explained with reference to FIG. 2.

Figure 2:
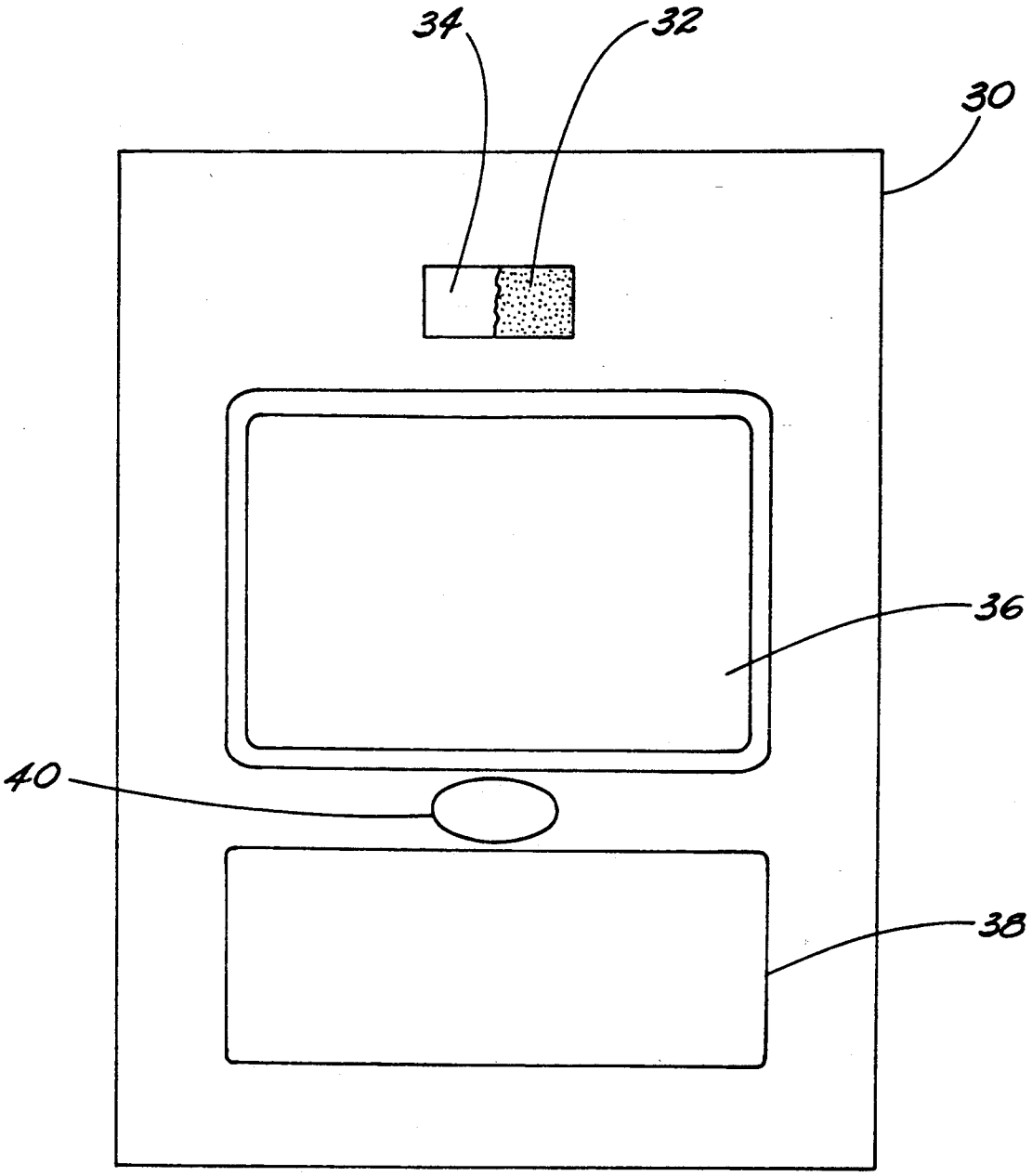
FIG. 2 is a plan view of the right-hand inside page of the romantic card.
Figure 2A:
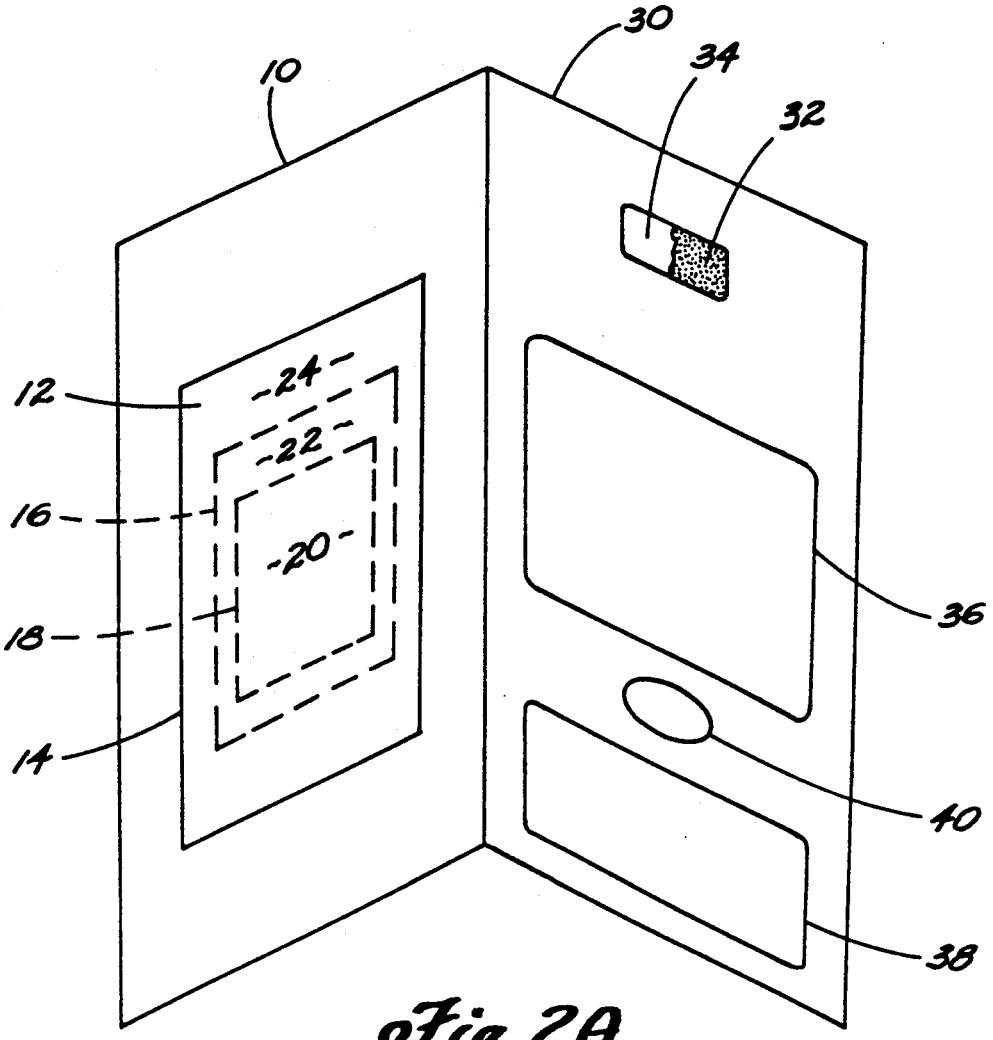
FIG. 2A is a perspective view of the inside of the card comprising the pages of FIG. 1 and FIG. 2, with the card being in a partly open condition about its line of folding so that its inside can be viewed.

This third page of the card is designated 30 in the drawing. It is manufactured so that the card paper contains thereon centered near the top of the page a small zone 32 of gluey, or sticky, material that is covered by a selectively removable covering, or release, paper 34. This is the hair-receiving-means. It is used by the sender for mounting some clippings from the sender's hair. The hair clippings are mounted by the sender peeling, either partially or entirely, covering paper from zone 32. FIG. 2 shows a portion of covering paper 34 broken away to expose a portion of the gluey material of zone 32. hair clippings are then adhered to the exposed zone of gluey material, and the covering paper is pressed back against the zone to secure the hair clippings. For decorative purposes, the exterior of covering paper 34 may have different colors, pictures, designs, or written words. It may also be sufficiently large to receive hair clippings from more than one person, and to provide space for writing each person's name next to his or her hair clippings. The hair-receiving-means may be positioned to allow to be stuck vertically, horizontally, or obliquely. There may also be more than one zone 32 on a card.

Below zone 32 in the center of page 30 is a larger zone 36 that forms a kiss-impression receiving means providing for the sender to place thereon a colored impression of his or her kiss by using a colorant previously applied to his or her lips. This zone is used by the sender kissing it with colorant previously applied to his or her lips, for example with lipstick or with the use of the special colorant and applicator package hereinafter to be described in detail. Zone 36 may be of a size that has sufficient space for allowing the sender to sign his or her name next to the impression of his or her kiss. Like zone 32, zone 36 may be sufficiently large for receiving more than one kiss-impression, and accompanying signature, if desired.

The bottom-most zone 38 contains some form of printed or written greetings or wishes which the sender desires to convey to the recipient.

Between zones 36 and 38 is a small zone 40 on which it is intended for the sender to place a fragrance, such as a perfume or aftershave. While the drawing illustrates the specific zone 40, the inclusion of such a zone is optional. If desired, the sender can place a fragrance on a portion of zone 36.

The fourth page is not illustrated in the drawings. It either contains only printed material or is left blank. The printed material may be short stories about great love affairs of the world, and one particular story that the reader may find enjoyable is the inventor's own work entitled "Special Kiss".

Figure 3:
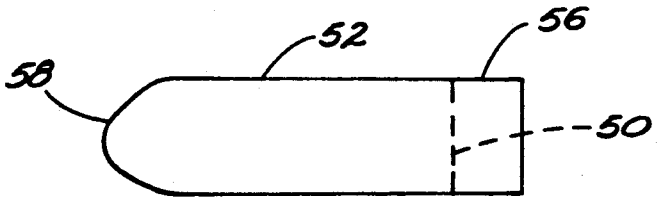
FIG. 3 is a top plan view of the applicator package for the lip colorant.
Figure 4:
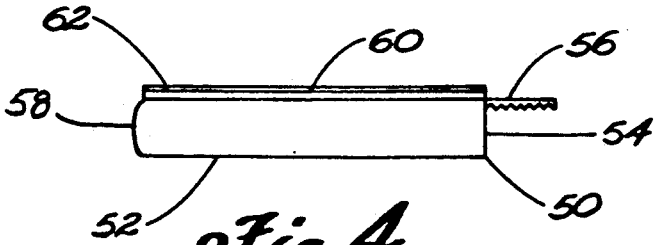
FIG. 4 is a front elevational view of FIG. 3.
Figure 5:
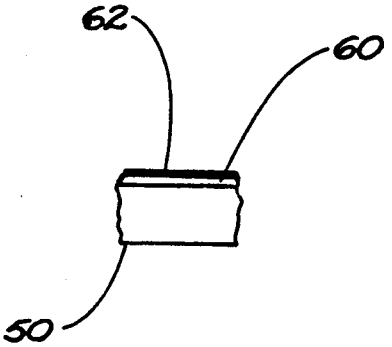
FIG. 5 is a left side elevational view of FIG. 3.

FIGS. 3, 4, and 5 relate to the colorant applicator package previously mentioned and now identified by the general reference number 50. The colorant applicator 50 comprises a small plastic envelope 52 which forms a finger pocket that can stretch to fit over one finger. The envelope is finger-shaped and has an opening 54 at one end via which the person's finger is inserted. Adjacent opening 54 the envelope has an integral tongue, or tab, 56 that may be used to assist in pulling the envelope onto the finger. Extending lengthwise from tongue 56 to the tip end 58 on the envelope's exterior is a film, or layer, of colorant, or coloring material, 60. This layer is overlaid by a removable plastic cover 62 which is removed to expose the colorant after the envelope has been positioned on the finger.

The colorant is used for coloring the sender's lips prior to the sender applying a kiss to zone 36. The colorant is a lipstick or equivalent. It may come in different colors, for example red for ladies, blue for men. By selling the applicator 50 in conjunction with the romantic card, the card may be conveniently used. The applicator may however be sold separately, and it may be used for other purposes besides creating a mark of the kiss impression applied to zone 36 on the romantic card. For example, it may be used by ladies as regular lipstick, and it may be used by anyone when the layer 60 is a medicating material and/or lip protecting material. It may also be used to deliver medications to certain areas of the body. It is intended that the applicator be disposable after it has been used, and the tongue 56 may be used to facilitate removal of the envelope from the finger.

Figure 6:
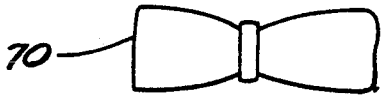
FIG. 6 is a top plan view of an accessory item that may be used with the romantic card.
Figure 7:
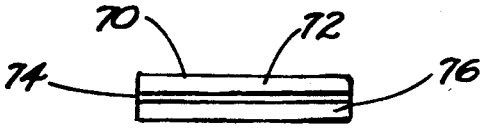
FIG. 7 is a front elevational view of FIG. 6.

FIGS. 6 and 7 disclose an accessory that may be used in conjunction with or independently of the romantic card. This accessory is "hair sticker" 70 that is used to stick hair clippings on the romantic card or on other form of greeting card. Hair sticker 70 is fabricated from plastic or paper or equivalent paper 72. It comes in the shape of a bow, as illustrated, or some other shape. Its back face has a gluey layer 74 covered with release paper 76 that is removed to expose the gluey layer at time of use. When put to use the sticker is stuck onto the hair clippings and the card, to hold the hair clippings in place, presenting them in a very special and romantic way.

Figure 8:
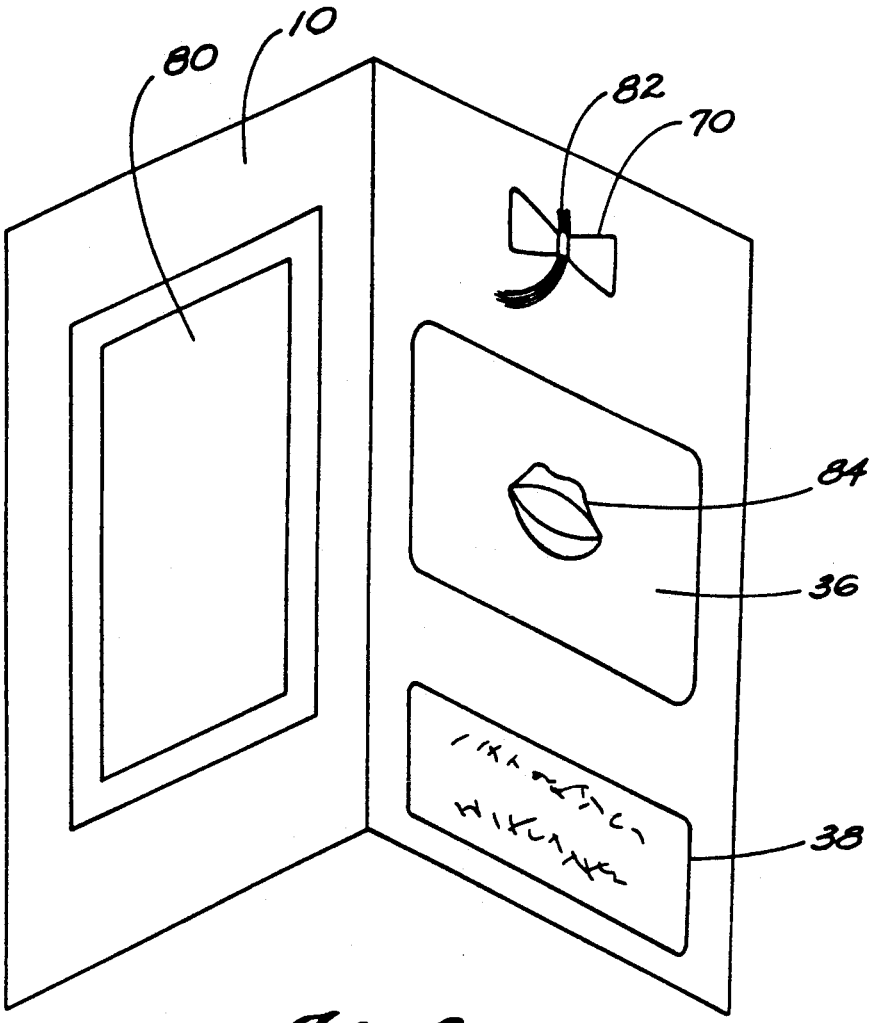
FIG. 8 is a perspective view of the two inside pages of a greeting card embodying the invention.

FIG. 8 shows the use of a greeting card embodying my invention. A picture 80 has been adhered to the left-hand inside page 10 after all or a portion of the covering paper 12 has been stripped to expose adhesive. Hair clippings 82 have been stuck on zone 32 and covered by a sticker 70 in the shape of a bow. An impression of the lips has been applied to zone 36, and a greeting has been written on zone 38.

In summary, this special romantic greeting card will allow people to send their pictures as well as their hair and imprint of their kisses with their perfume to make it possible for many to relay their nice and loving feelings to others with a romantic touch and enable them to enjoy nice massages from relatives and friends.

I claim:

1. A greeting card comprising two confronting interior pages joined by a line of folding, and an adhesive zone on one of said two pages that is covered by selectively strippable sections of release paper which when the card is used, may be selectively stripped from said adhesive zone so as to selectively expose selected areas of adhesive for reception of varying sizes of sheet material that is to be adhered thereto when the card is used, said adhesive zone occupying less than the entirety of said one page so as to exclude a margin of said one page, said margin, said adhesive zone and release paper being disposed on said one page so as to be covered by the other of said pages when said two pages are closed against each other by folding about said line of folding.

2. A greeting card as set forth in claim 1 in which said adhesive zone is rectangular in shape and said selectively strippable sections of release paper comprise a central rectangular section that is bounded by a succession of one or more rectangular perimeter frames.

3. A greeting card as set forth in claim 1 including a photograph of the sender of the card adhered to one or more exposed ones of said selected areas of adhesive.

4. A greeting card as set forth in claim 1 in which the other of said pages contains a further adhesive zone that is covered by strippable release paper.

5. A greeting card as set forth in claim 4 including hair clippings of the sender of the card mounted on said further adhesive zone.

6. A greeting card as set forth in claim 1 in which said other of said pages contains an imprint zone, and further including a colored impression of the lips of the sender disposed on said imprint zone.

7. A greeting card as set forth in claim 1 in which said other of said pages contains a fragrance zone, and further including a fragrance disposed on said fragrance zone.

8. A greeting card as set forth in claim 1 in which said other of said pages contains a greeting zone, and further including a greeting disposed on said greeting zone.

9. A greeting card as set forth in claim 1 in which said selectively strippable sections of release paper comprise a central core section that is bounded by a succession of plural frame sections.

10. A greeting card comprising two confronting interior pages joined by a line of folding, and an adhesive zone on one of said two pages that is covered by selectively strippable sections of release paper which when the card is used, may be selectively stripped from said adhesive zone so as to selectively expose selected areas of adhesive for reception of varying sizes of sheet material that is to be adhered thereto when the card is used, said adhesive zone and release paper being disposed on said one page so as to be covered by the other of said pages when said two pages are closed against each other by folding about said line of folding, in which the other of said pages contains a further adhesive zone that is covered by strippable release paper, hair clippings of the sender of the card mounted on said further adhesive zone, and including a cover in the shape of a bow applied over said hair clippings.

11. A greeting card comprising two confronting interior pages joined by a line of folding, and an adhesive zone on one of said two pages that is covered by selectively strippable sections of release paper which, when the card is used, may be selectively stripped from said adhesive zone so as to selectively expose selected areas of adhesive for reception of varying sizes of sheet material that is to be adhered thereto when the card is used, said adhesive zone and said release paper being disposed on said one page so as to be covered by the other of said pages when said two pages are closed against each other by folding about said line of folding, in which the other of said pages comprises hair clippings, a cover applied over said clippings, and an adhesive zone adhering said clippings and said cover on said other page.

12. A greeting card as set forth in claim 11 in which said adhesive zone is disposed on said other page.

* * * * *